US007591767B2

(12) United States Patent
Nardone

(10) Patent No.: US 7,591,767 B2
(45) Date of Patent: Sep. 22, 2009

(54) UNIVERSAL ADAPTER FOR EXERCISING STICKS

(76) Inventor: Moamar Nardone, Bakerstreet 50 A, Batasan Hills, Filinvest II, Commonwealth, Quezon City (PH) 1126

( * ) Notice: Subject to any disclaimer, the term of this patent is extended or adjusted under 35 U.S.C. 154(b) by 0 days.

(21) Appl. No.: 11/851,155

(22) Filed: Sep. 6, 2007

(65) Prior Publication Data

US 2008/0064574 A1 Mar. 13, 2008

(30) Foreign Application Priority Data

Sep. 8, 2002 (WO) ..... PCT/PH2006/000021

(51) Int. Cl.
*A63B 71/00* (2006.01)

(52) U.S. Cl. ..... 482/74; 482/51; 482/70; 482/71

(58) Field of Classification Search ..... 482/70–71, 482/74, 51, 75–77, 10–11, 121–130; 135/65, 135/135, 82, 75; 420/74
See application file for complete search history.

(56) References Cited

U.S. PATENT DOCUMENTS 2,253,012 A * 8/1941 Benner et al. ..... 280/842
4,326,708 A 4/1982 Hinds
5,181,894 A * 1/1993 Shieng ..... 482/70
6,045,487 A * 4/2000 Miller ..... 482/52
7,247,128 B2 * 7/2007 Oga ..... 482/51

* cited by examiner

*Primary Examiner*—Lori Amerson
(74) *Attorney, Agent, or Firm*—Adam K. Sacharoff; Much Shelist

(57) ABSTRACT

The present invention relates to a universal adapter for exercising sticks comprising a mounting means for stably and detachably securing at least an exercising stick in place, such that said adapter functions and forms as an extension of said stick when in use. The mounting means preferably comprises of an elongated member into which a stick-holding means is slidably, tensionally and adjustably mounted, such that said mounting means is capable of providing a varying resistive force against the pushing action of a user when in use, and an extension for increasing the stick's effective length, especially when used in combination and to complement a stationary exercising device such as, among others, a stepper, twister, treadmill, stationary bike, stair climber and combination thereof. This invention is useful to a person who is in an actual or simulative action of stepping, climbing, walking, skiing, or similar actions serving as an aid, balancer, stabilizer, or an exerciser especially for the arms and upper body.

11 Claims, 7 Drawing Sheets

UNIVERSAL ADAPTER FOR EXERCISING STICKS

TECHNICAL FIELD OF THE INVENTION

The present invention generally relates to construction forms and more specifically to a universal adapter for exercising sticks.

BACKGROUND OF THE INVENTION

It is well known in the prior art to which this invention appertains that utility or exercising sticks used as an aid in walking or skiing are commercially available in various forms, designs and styles for the satisfaction of the preferences of consumers or users. But there is one thing or feature that is still common to these sticks that is their being elongated or having an elongated body regardless of the variations in form, appearance or style. Oftentimes, such aesthetic aspect or feature of the stick is compromised or sacrificed by functional requirements such as: (1) the provision thereto of a form of resistance to the user's pushing action, (2) making the effective length thereof adjustable, and (3) making it conveniently adaptable as a complement for other related exercising devices such as a stepper or treadmill. Providing or incorporating all these functionalities into the stick is seemingly impractical as it would make it a complex device not anymore suitable for use as a simple personal stick. A form of an adapter that can accommodate all these functionalities while temporarily becoming part of any types of stick would be a perfect solution to the shortcomings of the prior art.

There are disclosures in the prior art for sticks with accessories attached thereon such as holding implements or unit for other gadgets or components thereof not in use at the moment. Patent Nos. EP1547655 and DE10340135 disclose and teach such type of sticks commonly used for Nordic walking, trekking or skiing.

SUMMARY OF THE INVENTION

The invention seeks to overcome the shortcomings of the prior art by providing a universal adapter for exercising sticks (10) that comprises of a mounting means (11) for stably and detachably securing any types of exercising stick (12) in place. The mounting or placement of the stick (12) in the adapter (10) makes the latter to form part or as an extension of the stick (12) when in use, hence, performing functions for the sticks such as those aforementioned in the preceding discussion on the prior art. The mounting means (11) preferably comprises of an elongated member (14) into which a stick-holding means (13) is slidably, tensionally and adjustably mounted, such that the mounting means (11) is capable of providing a varying resistive force against the pushing action of a user when in use, and an extension for increasing the stick's effective length, especially when used to complement a stationary exercising stepper device.

The primary object therefore of the present invention is to provide a universal adapter for exercising sticks that is capable of accommodating the placement or mounting therein of any type of utility or exercising sticks enabling them to perform such other functions as providing a varying resistance to the pushing action applied thereon, providing an extension thereto as maybe desired by the user, and complementing a stationary exercising stepper and/or twister, treadmill, stationary bicycle, stationary stair climber or any similar devices in the most practical, flexible and convenient way. This invention is useful to a person who is in an actual or simulative action of stepping, climbing, walking, skiing, or similar actions serving as an aid, balancer, stabilizer, or an exerciser especially for the arms and upper body.

Another object of the present invention is to provide a universal adapter for exercising sticks that readily blends with the form, appearance or style of the sticks mounted thereon due to its elegance and ergonomic features.

Still another object thereof is to provide an universal adapter for exercising sticks that has a very simplistic, but practical structural design and construction, thus, most economical to manufacture and highly marketable to commercialize.

BRIEF DESCRIPTION OF THE DRAWINGS

Other objects and advantages of the present invention will become apparent, understood and appreciated upon reading the following detailed description taken in conjunction with the accompanying drawings, in which.

DETAILED DESCRIPTION OF THE INVENTION

Before describing the preferred embodiments of the invention in detail, it is to be understood that the phraseologies and terminologies employed herein are for purposes of description and should not be regarded as limiting.

Figure 1:
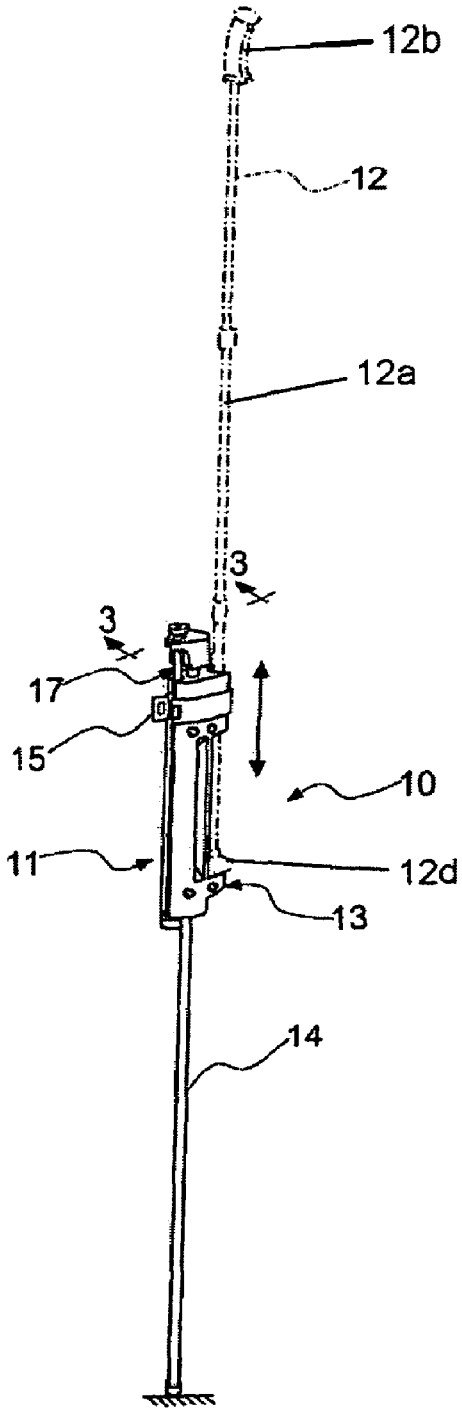
FIG. 1 is a perspective view of a preferred embodiment of the present invention in a normal position.
Figure 1A:
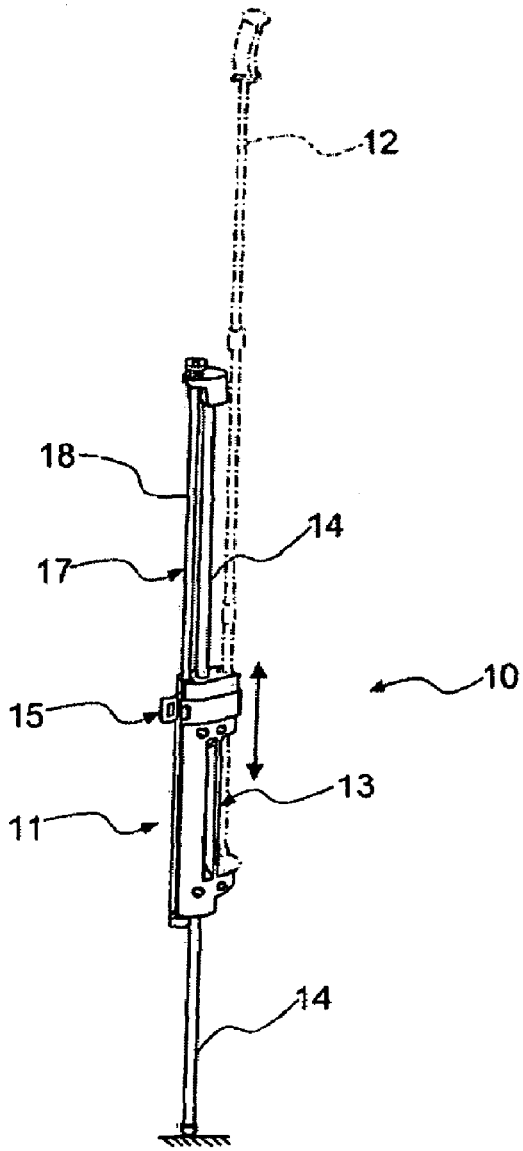
FIG. 1*a* is perspective view thereof with the stick in place being pushed in use.

Referring now to the drawing in which like reference numerals designate the same steps, components or elements all throughout the succeeding description, there is shown in FIG. 1 a universal adapter for exercising sticks is generally designated by reference numeral 10. The exercising stick 12 may be any well known stick used as an aid in walking or skiing and typically includes a shaft 12*a* having a handle 12*b* secured about the upper end of the shaft 12*a* and includes a ring 12*c* positioned about the lower end 12*d* such that a lower end tip 12*e* extends past the ring 12*c*. The universal adapter 10 includes a mounting means 11 for stably and detachably securing at least an exercising stick 12 in place, such that the adapter 10 functions and forms as an extension of the stick 12 when in use, defining an adapter 10 and stick 12 assembly 10*a* whose lower end portion 14*a* that makes contact with a rigid surface 14' is that of the adapter 10.

Figure 2:
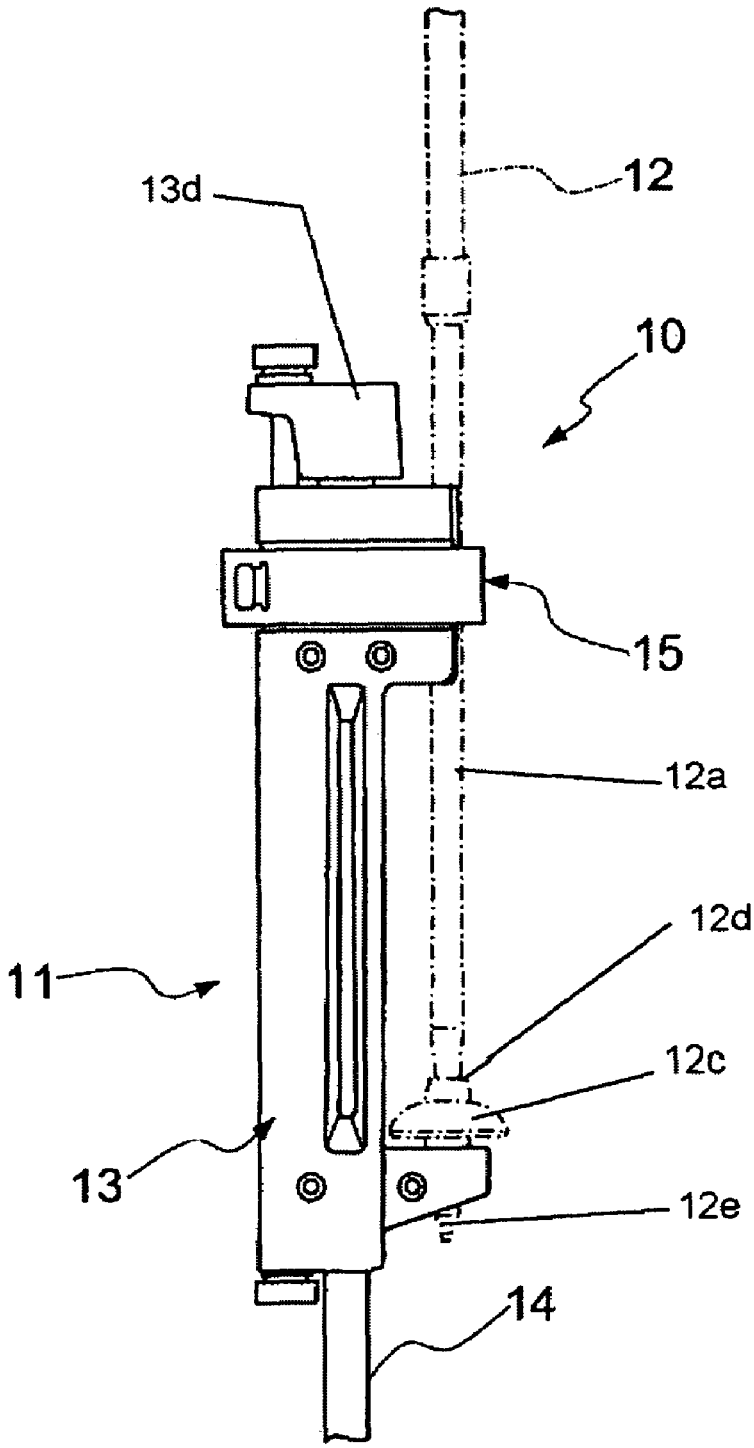
FIG. 2 is a cross-sectional view taken along line 2-2 of FIG. 1.
Figure 3:
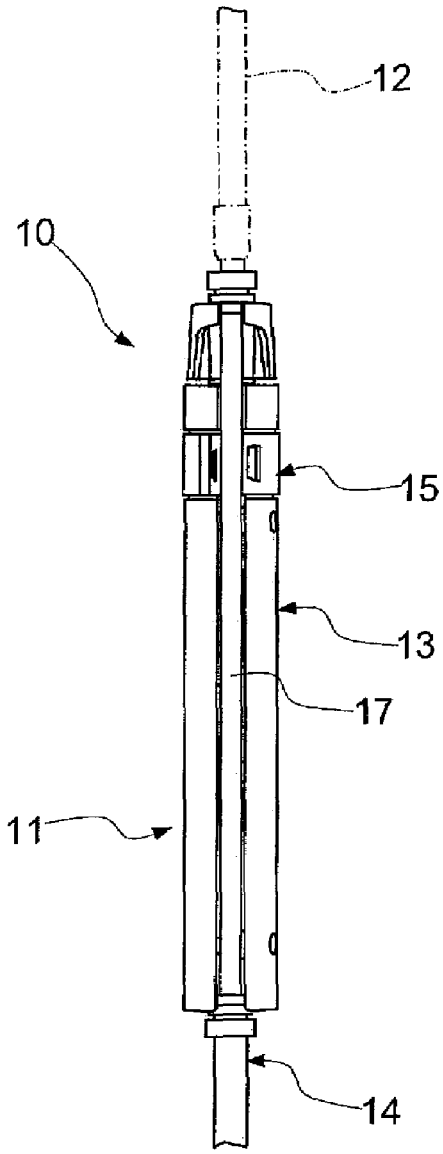
FIG. 3 is a front view thereof.
Figure 4:
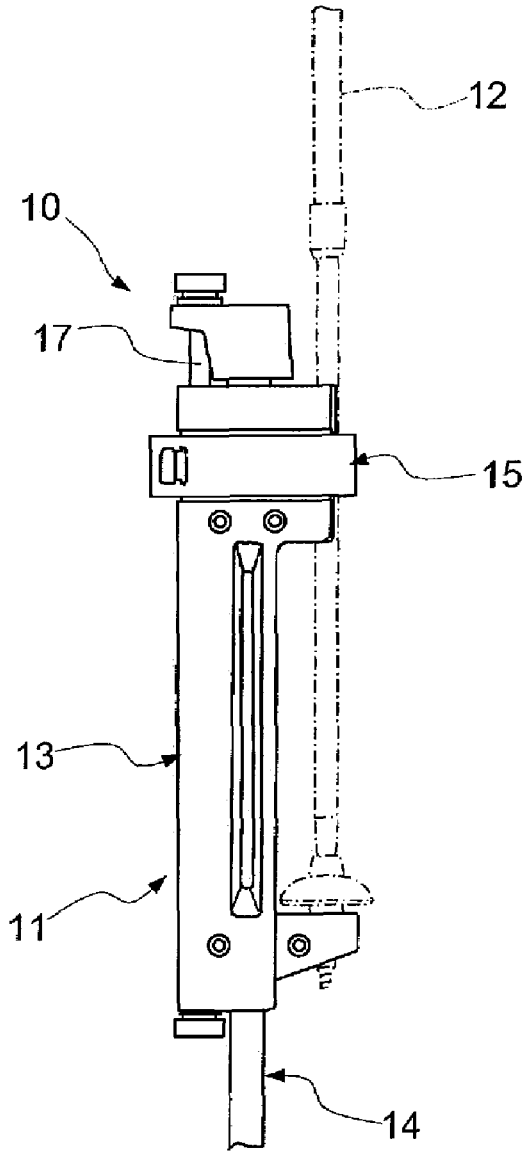
FIG. 4 is a side elevational view thereof.
Figure 5A:
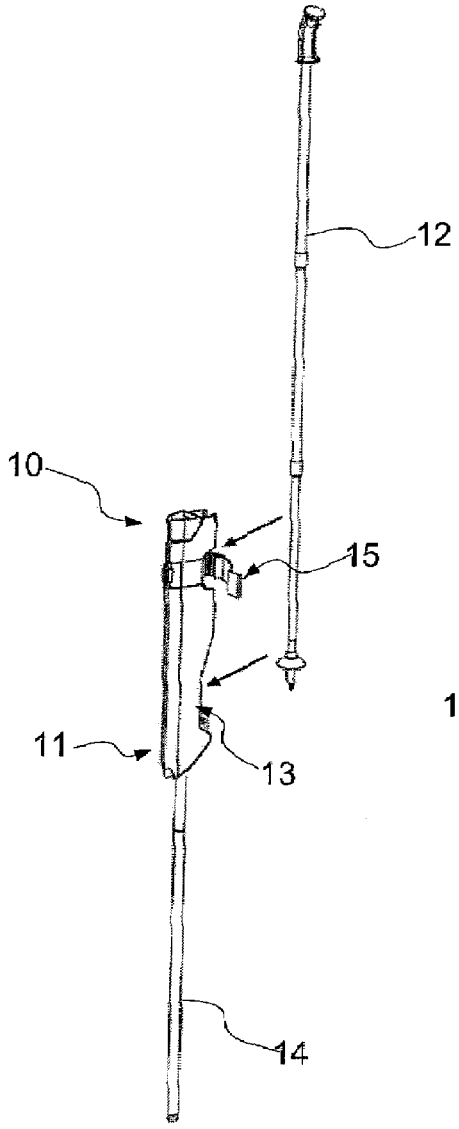
FIG. 5*a* is a perspective view thereof showing the stick in exploded position with respect to a stick-holding means (shown also in FIGS. 5*b* to 7) having a slightly different form from the preferred embodiment shown in FIG. 1.
Figure 5B:
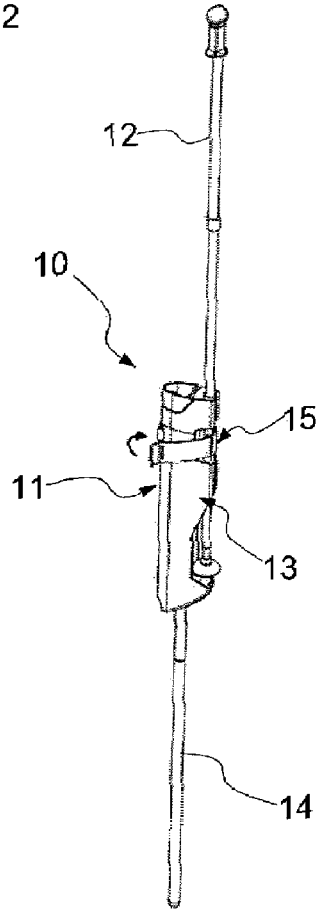
FIG. 5*b* is a perspective view thereof showing the strap in an open position.
Figure 5C:
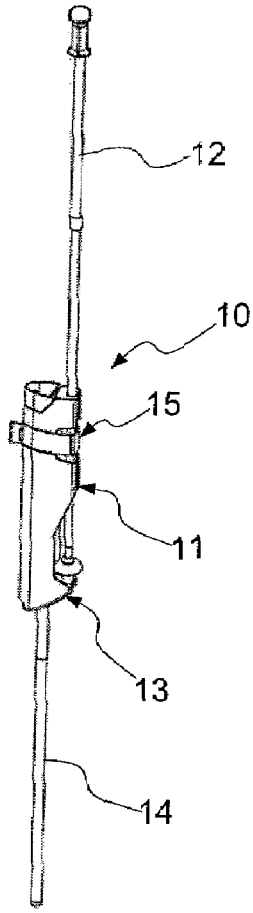
FIG. 5*c* is a perspective view thereof showing the strap in a close position.
Figure 6:
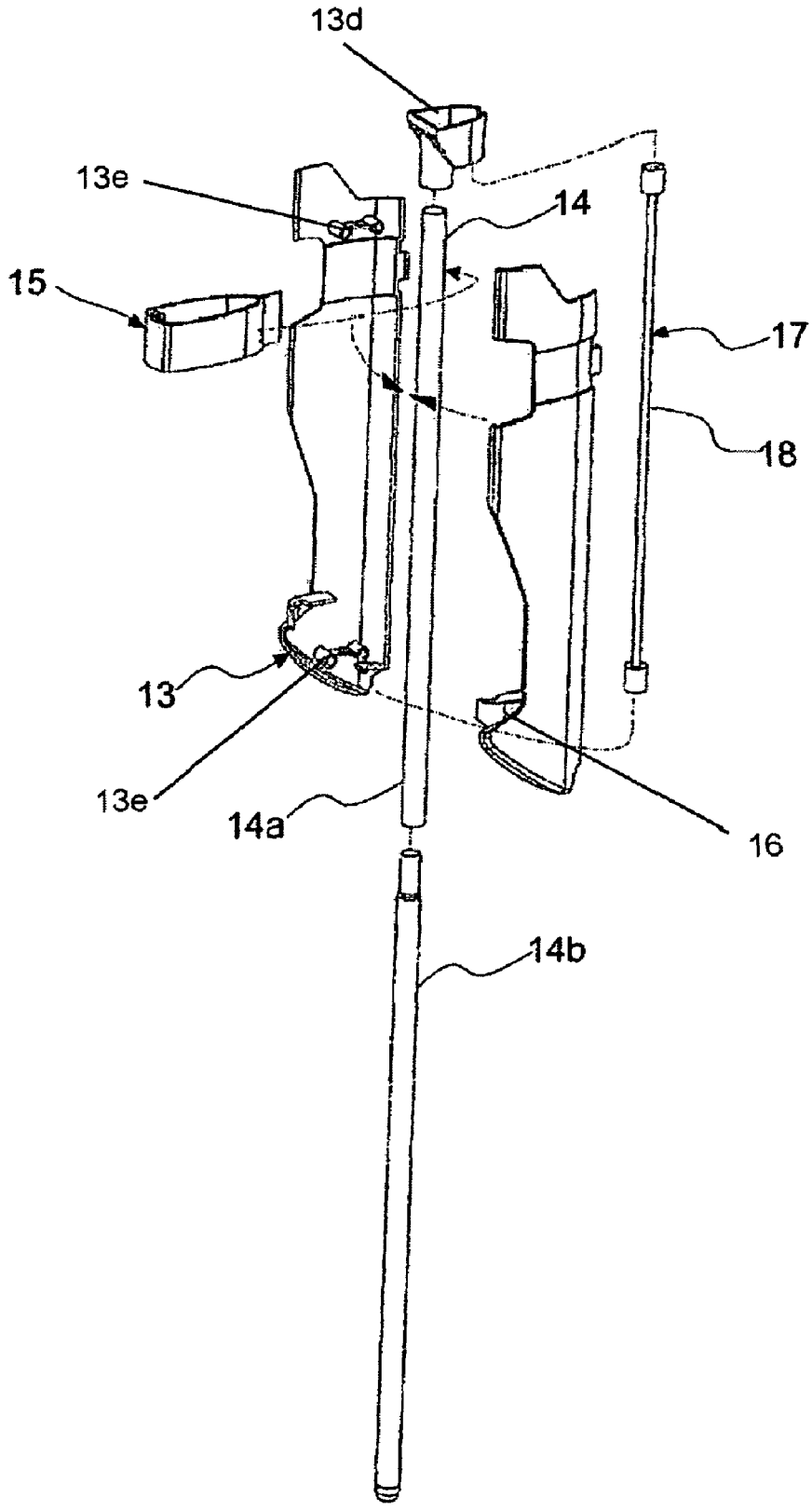
FIG. 6 is an exploded, perspective view thereof showing the components or elements thereof in detail.
Figure 7:
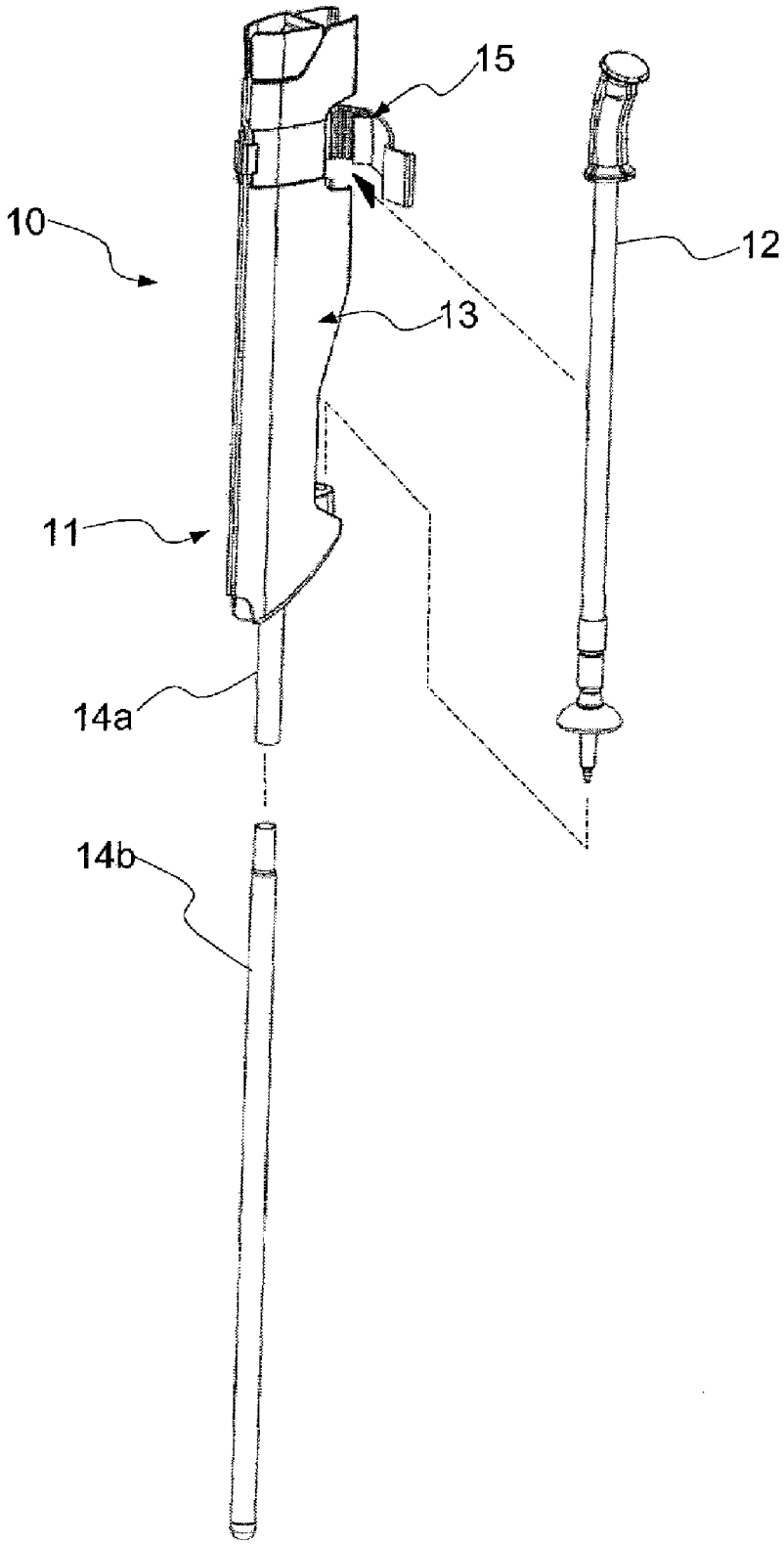
FIG. 7 is an enlarged, exploded, perspective view thereof showing the stick and collapsible elongated member thereof in exploded position.

It is preferred that the mounting means 11 has an adjustable effective length to conveniently meet user's preferences and requirements. To be an effective exercising device when the stick 12 is held therein, the mounting means 11 is preferably provided with a means 17 for providing a varying resistive force to act against the pushing action of a user when in use. The means 17 is preferably in a form of a tension cord member 18 that is mounted on the mounting means 11, such that pushing the combined the stick 12 and the mounting means 11 against a rigid surface stretches the cord member 18 effecting a resistance that varies based on the size and type of the member 18 adopted or preferred. In the illustrative example shown in the drawing, the cord member 18 is connected at the upper end portion thereof to the elongated member 14 via the upper end cap 13*d*, and to the stick-holding means 13 at the lower end portion thereof as shown in FIGS. 1 and 2.

The mounting means 11 preferably comprises of a stick-holding means 13 and an elongated member 14 into which the stick-holding means 13 is slidably, lockably, tensionally and adjustably mounted. The elongated member 14 is positioned in clips 13*e* placed in the upper and lower portion of the stick-holding means 13 that help position the elongated member 14 but allow it to slide therein. The stick-holding means 13 has at least a fastening means 15 for stably and detachably holding the stick 12 in place. The means 15 is being complemented by an apertured arm member 16 into which the bottom end portion of the stick 12 is securely mounted and held in place. For storage or safekeeping convenience when the adapter 10 is not in use, the mounting means 11, or specifically the elongated member 14, is preferably made collapsible such that it can be dismantled in a facile way for storage purposes, hence, the elongated member 14 comprises of detachable or collapsible members 14*b* and 14*c* that are jointed together when the adapter 10 is in use.

In usage, the assembly of the adapter 10 and stick 12 is conveniently used in combination with an exercising device 19, especially a stepper and/or twister device 19*a*, wherein the assembly is pivotably mounted-rearwardly of the device 19*a*. The assembly 10*a* can also be used in combination with a treadmill, stationary bike, stationary stair climber, and other stationary exercisers.

Figure 8:
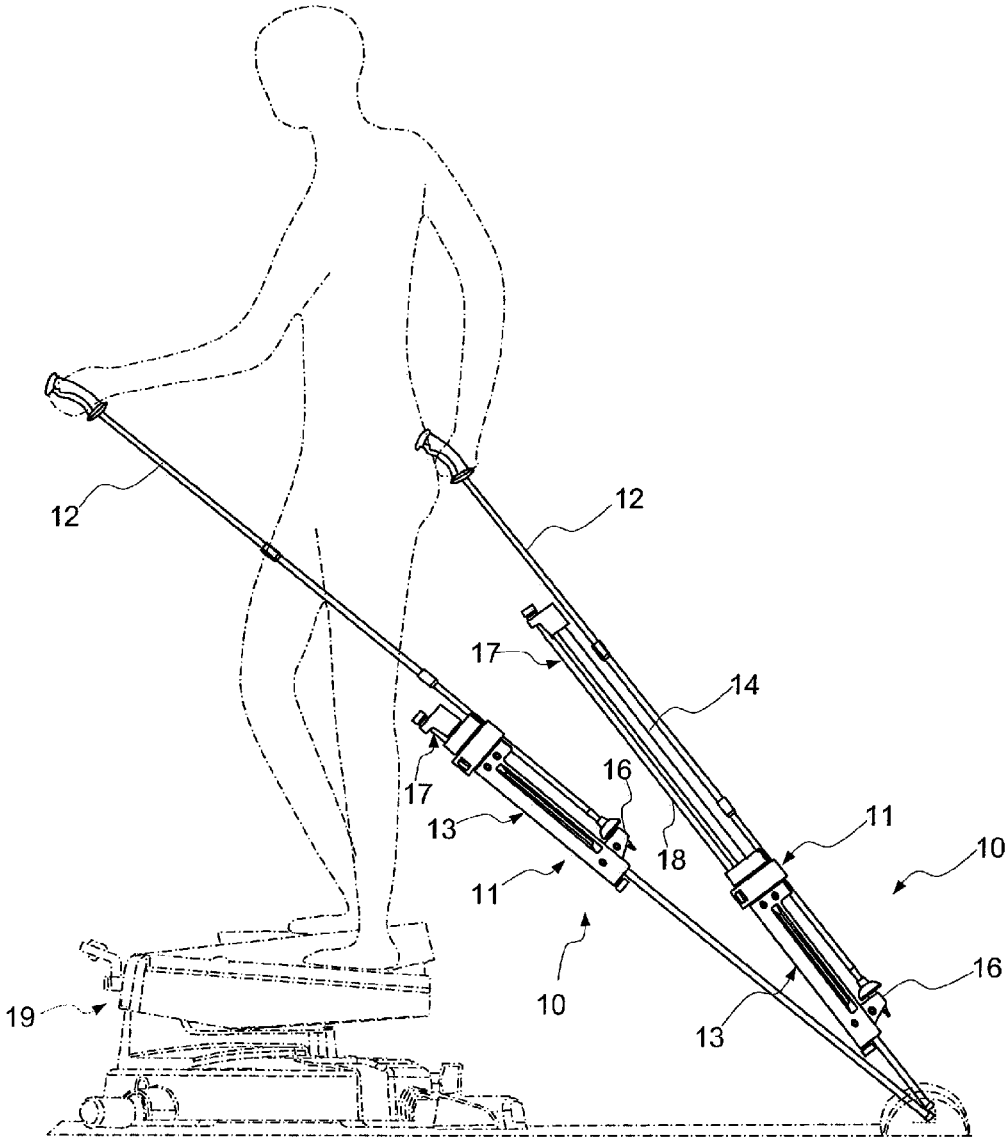
FIG. 8 is an elevational side view thereof in combination with an exercising device and a mat, together with an inset view of the mat captioned as FIG. 8*a*.

When in use in combination with and to complement a stationary exercising device 19, especially a stepper and/or twister device 19*a*, the invention is preferably used in combination with a mat 20 having a means 21 for pivotally mounting the lower end portion 14*a* of the assembly 10*a* as shown in FIGS. 8 and 8*a*, thus, preventing the end portion 14*a* to move or slide along the surface of the mat 20, while allowing same to freely pivot thereon. When in use, the exercising device 19, specifically the stepper and/or twister device 19*a*, is preferably placed on the mat 20 serving as a base floor mat with the means 21 on which the end portion 14*a* pivots being located at a pre-determined proximate location depending on what type of exercising device 19 is used, which is at a certain distance at the back of the exercising device 19 in the case where the latter is a stepper and/or combined stepper and twister device 19*a* as shown in FIG. 8. The means 21 is preferably in a form of a protrusion 22 having at least a cavity 23 that accommodates the mounting of the end portion 14*a* of the assembly 10*a* as shown in FIGS. 8 and 8*a*. The mat 10 can be rolled up into a cylindrically rolled position or state 8*b* for storage purposes as shown in the inset view in FIG. 8*a*.

The present invention embodying the universal adapter 10 can accommodate the mounting of the stick 12 that can be any types of utility sticks, especially exercising sticks, such as stick for Nordic, brisk or ordinary walking, skiing stick, jumping pole, mountain climbing stick, or stick used in trekking.

Before defining the scope of the following claims, it is to be understood that the invention is not limited in its applications to the details of the embodied device set forth in the preceding description or illustrated in the drawings. It is to be noted that the invention is capable of other embodiments and limitless applications not disclosed herein, and of being practiced and carried out in various ways falling within the teaching and scope of the following claims.

What is claimed is:

1. A universal adapter for exercising sticks having a shaft with a handle on the top end and a lower end defining a lower end tip, the adapter comprising:

a mounting means for stably and detachably securing at least an exercising stick in place, such that said universal adapter functions and forms as an extension of said stick when in use, defining an adapter and stick assembly whose lower end portion that makes contact with a rigid surface is that of said adapter, wherein the mounting means includes:

a stick holding means defining a housing with a lower portion that extends outwardly from the housing and an upper portion that extends outwardly from housing such that the housing has a defined middle portion that recessed from the outwardly extending lower and upper portions, the lower portion further has an aperture arm member that secures the lower end tip of the shaft in place and the upper portion further has a channel for holding the shaft in place;

an elongated member having an upper end secured to an upper end cap, the elongated member being slidably mounted in clips defined within the stick holding means; and a tension cord member having an upper end secured to the upper end can and a lower end secured about the lower portion of the housing, the tension cord member being in tension when stretched, wherein a user holding the handle of the shaft and applying force on the mounting means causes the stick holding means to slide along the elongated member that moves the upper end cap away from the stick holding means to stretch the tension cord member which has a tendency to return the stick holding means such that the tension cord is unstretched.

2. The universal adapter for exercising sticks according to claim 1 wherein said mounting means has an adjustable length.

3. The universal adapter for exercising sticks according to claim 1, wherein said stick-holding means having at least a fastening means for stably and detachably holding said stick in place, said fastening means being complemented by the aperture arm member.

4. The universal adapter for exercising sticks according to claim 1 or 2 wherein said mounting means is collapsible which can be dismantled for storage.

5. The universal adapter for exercising sticks according to claim 1 wherein said elongated member comprises of detachable or collapsible members that join together when the adapter is in use.

6. The universal adapter for exercising sticks according to claim 1, wherein said adapter and stick assembly is used in combination with and to complement a stationary exercising device selected from a stepper, twister, treadmill, stationary bicycle, stationary stair climber and combination thereof.

7. In combination, a universal adapter for exercising sticks according to claim 1, further comprising: a mat, on which an exercising device is placed, having a means for pivotally mounting the lower end portion of said assembly, being disposed at the rear portion thereof, preventing said lower end portion that is being mounted thereon, to move or slide along the surface of said mat, while allowing said end portion to freely pivot thereon when in use.

8. A universal adapter for exercising sticks according to claim 7 wherein said means for mounting is in a form of a protrusion having at least a cavity that accommodates the mounting of said end portion of said assembly.

9. A universal adapter for exercising sticks according to claim 1 wherein said stick is selected from walking stick, skiing stick, jumping pole, and mountain climbing stick.

10. An adapter for an exercising stick that has a shaft with a handle on the top end and a lower end tip, the adapter comprising:

a stick holding means defining a lower extension portion having an aperture arm member that secures the lower end tip of the shaft in place and defining an upper extension portion having a channel for holding the shaft in place;

an elongated member having an upper end secured to an end cap, the elongated member being slidably mounted in clips defined within the stick holding means; and a tension cord member having an upper end secured to the end cap and a lower end secured about the lower extension portion of the stick holding means, the tension cord member being in tension when stretched, wherein a user holding the handle of the shaft and applying force causes the stick holding means to slide along the elongated member, which moves the end cap away from the stick holding means to stretch the tension cord member which has a tendency to return the stick holding means such that the tension cord member is un-stretched.

11. The universal adapter according to claim 10, wherein said stick-holding means further has a fastening means for stably and detachably holding said stick in place, said fastening means being complemented by the aperture arm member.

* * * * *